United States Patent [19]

Holmes et al.

[11] 3,959,946

[45] June 1, 1976

[54] POLE STRUCTURE

[75] Inventors: Harold Edwin Holmes, Clovelly; Enzo Oriolo, Darling Point, both of Australia

[73] Assignee: Electric Power Transmission Pty. Limited, Australia

[22] Filed: July 3, 1974

[21] Appl. No.: 485,530

[30] Foreign Application Priority Data

June 27, 1973 Australia ..... 3854/73

[52] U.S. Cl. ..... 52/731; 52/DIG. 8; 52/720

[51] Int. Cl.[2] ..... E04C 3/30; E04C 3/34

[58] Field of Search ..... 52/727, 728, DIG. 8, 52/731, 221, 720

[56] References Cited

UNITED STATES PATENTS

| | | | |
|---|---|---|---|
| 1,813,873 | 7/1931 | Brogden | 52/727 |
| 1,860,205 | 5/1932 | Schenker | 52/727 |
| 1,878,799 | 9/1932 | Ne Page | 52/221 |
| 2,062,399 | 12/1936 | Coddington | 52/727 |
| 2,145,232 | 1/1939 | Bauer | 52/720 |
| 2,988,182 | 6/1961 | Campbell | 52/720 |
| 3,263,302 | 8/1966 | Handley | 52/720 |
| 3,413,775 | 12/1968 | Katz | 52/727 |
| 3,557,422 | 1/1971 | Pfaff, Jr. | 52/731 |
| 3,570,208 | 3/1971 | Sei Nikai et al. | 52/727 |

*Primary Examiner*—Ernest R. Purser
*Assistant Examiner*—Robert Farber
*Attorney, Agent, or Firm*—D. Paul Weaver

[57] ABSTRACT

This invention relates to a pole structure comprising one series of alternate sides in a first form and another series of alternate sides in a second form, said first form comprising structural plates which are joined by one or more bracing members, and said second form comprising shrouds attached to the structured plates to form an enclosed pole structure, at least one of the other series of alternate sides having the shrouds removably or hingedly attached.

4 Claims, 5 Drawing Figures

POLE STRUCTURE

This invention relates to pole structures particularly for carrying electrical transmission lines.

Pole structures carrying electrical transmission lines have been in use for many years. The traditional lattice-work type structure, with bracing struts, connecting adjacent legs are well known. However these structures are often considered lacking in aesthetic appearance. Much emphasis is now being placed on environmental aspects of structures in relation to visual pollution, so a more aesthetic looking pole structure is required, but it must be as functional as at present.

Pole structures of a sealed nature, are more pleasing in appearance, but present problems for maintenance and construction. By their very nature, accessibility to the interior of the pole for maintenance is difficult if not impossible. As the pole structures vary in diameter up to in excess of eight feet, highly sophisticated and expensive equipment is needed for their manufacture.

This invention overcomes these problems in known poles. The pole structure of this invention is enclosed on all sides so it is aesthetic in appearance and overcomes the visual pollution of the lattice-work type pole structures. However, there is inherently access to the interior of the structure which can be made by conventional components and methods thereby overcoming the problems of construction of the sealed pole structures.

This invention also has the advantages that attachments can be made to the pole structure such that the attachment means do not detract from the visual line of the structure. The pole structure has shrouds which are placed on alternate sides of the pole structure so that they wrap over a portion of the other alternate sides, such that they form recessed faces. On the recessed faces the attachments are fixed such that the connecting means do not detract from the visual line of the structure. Another advantage of this invention is that as the shrouds can be produced by simple process the cost of the structure is very much cheaper than the prior art sealed pole structures.

In one broad form the invention comprises a pole structure characterised by having first alternate sides comprising structural plates which are joined by one or more bracing members, with the other sides clad with removable shrouds to form an enclosed pole structure with first alternate sides forming a recessed face.

These and other advantages of the present invention will become clearer when exemplary embodiments of this invention are described with reference to the following drawings in which:

FIG. 1 shows a four sided pole structure in which two opposite structural joining sheets are joined by a bracing member 7 which is of sufficient thickness to take the sheer force of the pole structure. Shrouds 1 are connected across the open sides of the pole structure and secured to the structural plates 2 such that they are removable.

Figure 1:
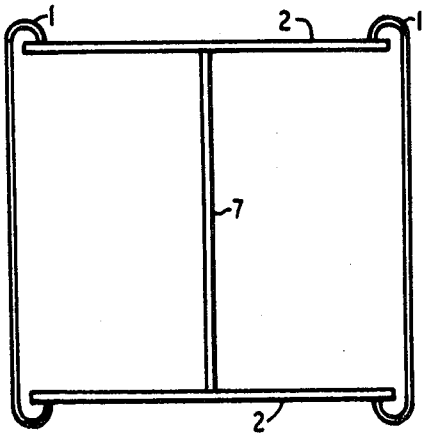
FIG. 1 shows a schematic representation of one embodiment of the invention.

The bearing member 7 in FIG. 1 may consist of a single member the length of the tower with a 0.8% taper.

The structural plates 2 may be comprised of three distinct sections without any taper, each section being smaller in width than the section below. However, because of the shrouds connected across the open sides of the structures the stepped formation of the structural plates is not noticed and the pole structure appears to have a tapering profile.

Figure 2:
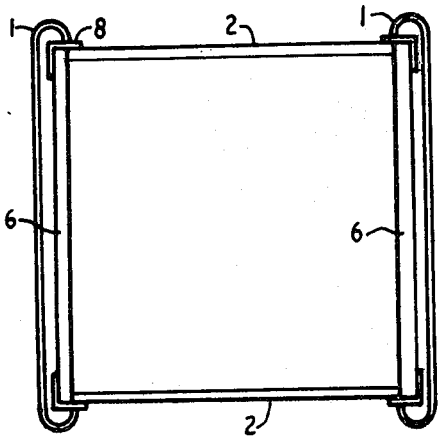
FIG. 2 shows a schematic representation of a further embodiment of the invention.

FIG. 2 represents another embodiment of the invention in which the structure consists of four leg members 8 joined together on two alternate sides by structural plates 2 and on the other two alternate sides by bracing angle struts 6 in a lattice type structure. This lattice work structure is then clad with shrouds 1 to form a sealed structure with the structural plates 2 forming a recessed face.

Figure 3:
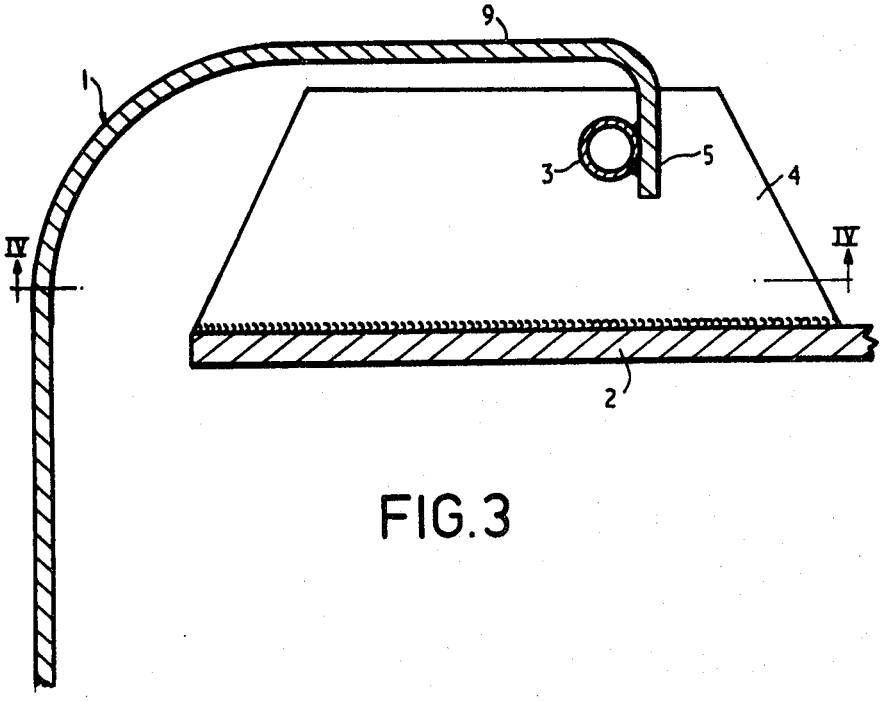
FIG. 3 shows a close up section of a corner of a shroud sheet when connected to a pole structure according to one embodiment of the invention.
Figure 5:
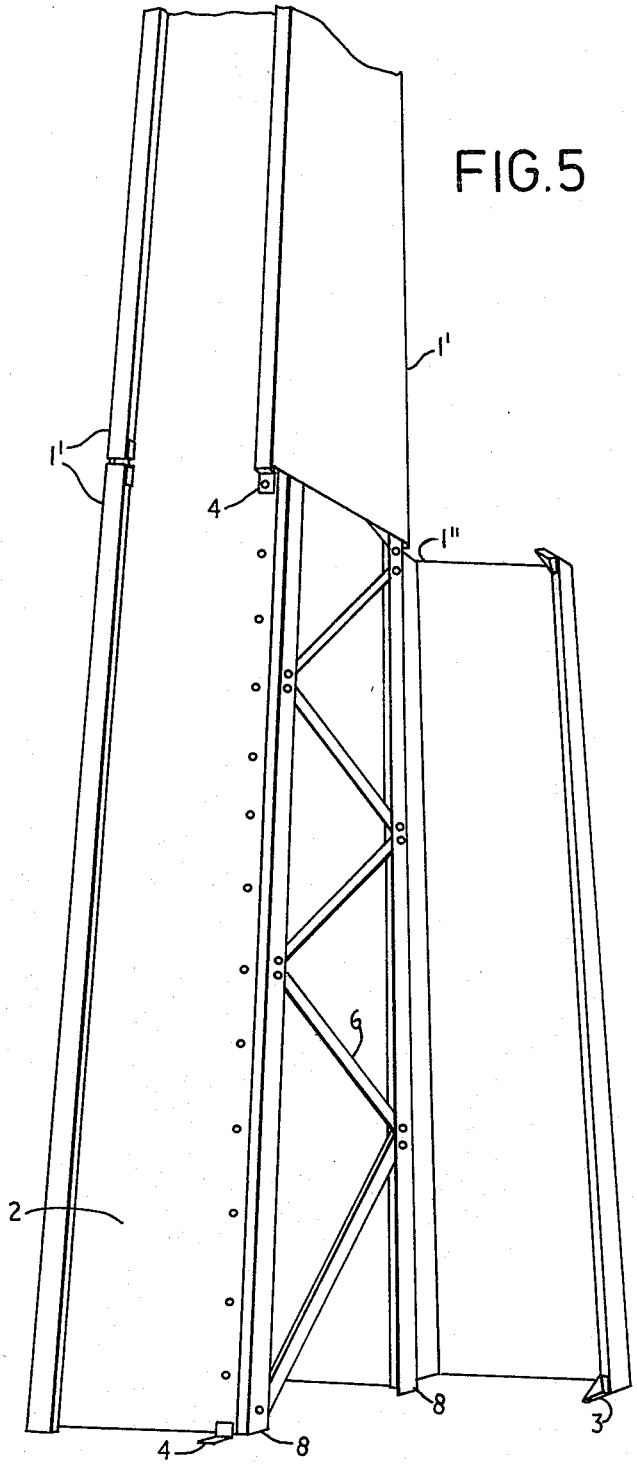
FIG. 5 is a perspective view of a pole structure having the shrouds in accordance with the invention, one shroud being shown in an open position.

The shrouds 1 can be made in any manageable sections so as to facilitate erection of the pole structure and there can be gaps between the shrouds of approximately ½ in. without spoiling the aesthetic lines of the structure. Because of the use of the cladding sheets and the formation of a recessed face on alternate sides of the structure the tolerance required for the dimensions of the parts of the structure can be abnormally large without significantly alternating the visual lines of the structure. In FIGS. 3 and 5, two methods of connecting the shroud to the pole structure are shown.

In FIG. 3 the shroud 1 consists of 3 millimeter thick sheeting having a 50 mm or 75 mm radius on the corner of the shroud which bends covering a portion of the structural plates with a second bend on the edge of the shroud 5 which extends approximately 30 millimeters back towards the structural plate 2. The length of the section 9 of the shroud between the first bend and the bent edge 5 of the shroud 1 is approximately 90 millimeters. The shroud 1 is then connected by a special hinge 3 to a cleat 4 which is riveted or joined by any suitable means to the structural plate 2.

Figure 4:
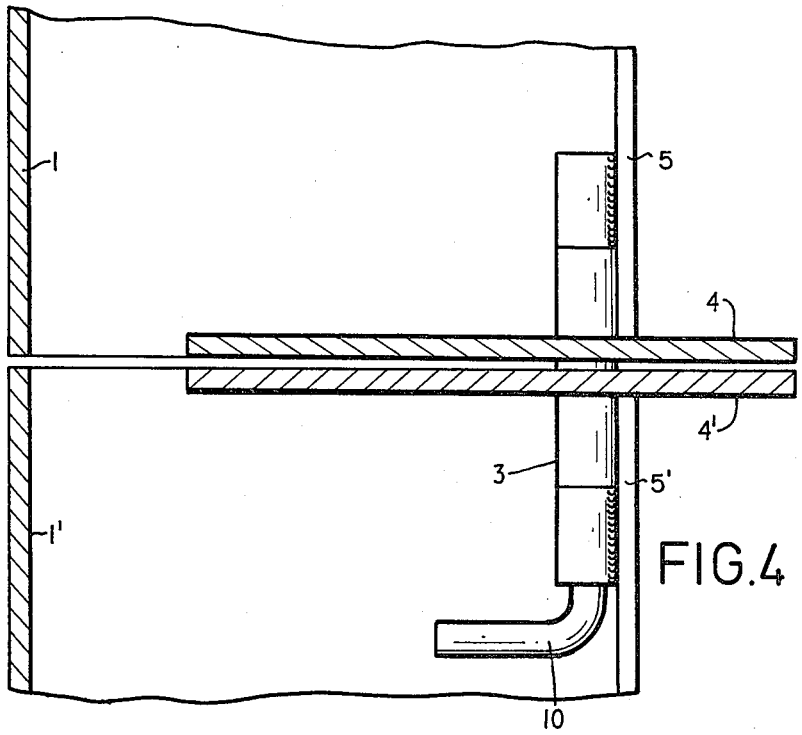
FIG. 4 is the sectional view through the line IV–IV of FIG. 3 near the ends of two shrouds.

FIG. 4 shows the special hinge 3 passing through two adjoining shrouds 1 and 1'. The hinge 3 is a special locking hinge which can act as a hinge or act as a lock. Simply by turning the lever 10 the pin in the hinge is removed and the shroud is free to turn on the hinges on the other side connecting it to the structural joining plates.

A hinge 3 is located at each corner of the shroud 1 such that the shrouds can open in any direction. Therefore the bottom shrouds are locked and may only be opened by a special key. However, once these are opened a special device can be used to unlock any of the desired hinges, thus opening the shrouds and gaining easy access for maintenance work.

Referring to FIG. 5, a pole structure embodying the invention is illustrated and the upward tapering configuration of the pole is shown. One of the aforementioned structural plates 2 is visible in FIG. 5 together with an adjacent side having the lattice-type bracing 6, covered and concealed by hinged sections of the shrouds 1. A single shroud section 1'' is shown in the open position to provide access to the interior of the pole structure.

As can be seen in FIG. 3 attachments can be fitted on to the recessed face such that the actual attachment means do not project beyond the shroud and therefore do not spoil visual lines of the pole structure.

I claim:

1. A pole structure for supporting electrical power transmission lines or the like, said pole structure being at least four sided in cross section, one pair of opposing sides of the pole structure formed by substantially imperforate structural plates which extend continuously for substantially the entire height of the pole structure, the other pair of opposing sides of the pole structure being formed of open lattice-type bracing which extends continuously for substantially the entire height of the pole structure in interconnecting relationship with said one pair of sides, the improvement which comprises substantially imperforate shrouds hinged along corresponding longitudinal edges to at least one side of the pole structure in said one pair, said shrouds arranged in end-to-end relationship adjacent said other pair of sides and forming substantially continuous uninterrupted coverings for said other pair of sides for substantially the entire height of the pole structure, whereby said open lattice-type bracing is fully concealed and the pole structure has an aesthetic appearance imparted to it.

2. The structure of claim 1, in which each shroud is hinged to the pole structure along both of its longitudinal edges for opening selectively in either of two directions to provide access to the pole structure interior.

3. The structure of claim 2, and each shroud having longitudinal edge flange portions projecting inwardly from the plane of the shroud along its full length and overlapping adjacent edge portions of said one pair of sides formed by said imperforate structural plates, said overlapping edge flange portions imparting to said one pair of opposing sides a symmetrically recessed appearance for the entire height of the pole structure.

4. The structure of claim 3, and said pole structure tapering in cross section gradually toward the top of the pole structure on all sides thereof.

* * * * *